US006168123B1

(12) United States Patent
Stein et al.

(10) Patent No.: US 6,168,123 B1
(45) **Date of Patent: *Jan. 2, 2001**

(54) AUTOMATIC GOLF BAG SUPPORT STAND

(75) Inventors: Louis Cobi Stein, Holyoke; Chuck Heidenreich, Westfield, both of MA (US)

(73) Assignee: Spalding Sports Worldwide, Inc., Chicopee, MA (US)

( * ) Notice: Under 35 U.S.C. 154(b), the term of this patent shall be extended for 0 days.

This patent is subject to a terminal disclaimer.

(21) Appl. No.: 09/433,125

(22) Filed: Nov. 3, 1999

Related U.S. Application Data

(63) Continuation of application No. 08/982,558, filed on Dec. 2, 1997.

(51) Int. Cl.[7] ..... A63B 55/00

(52) U.S. Cl. ..... 248/96; 248/97; 248/167; 248/168; 248/169; 248/170

(58) Field of Search ..... 248/96, 97, 167, 248/168, 169, 170

(56) References Cited

U.S. PATENT DOCUMENTS 4,834,235 * 5/1989 Solheim et al. ..... 248/96 X
4,921,192 * 5/1990 Jones ..... 248/96
5,152,483 * 10/1992 Maeng ..... 248/96
5,356,003 * 10/1994 Gretz et al. ..... 248/96 X
5,415,285 * 5/1995 Reimers ..... 248/96 X
5,662,296 * 9/1997 Wu ..... 248/96
5,857,567 * 1/1999 Cheng ..... 248/96 X
5,887,833 * 3/1999 Sundara et al. ..... 248/96
5,901,845 * 5/1999 Cheng ..... 248/96 X

* cited by examiner

*Primary Examiner*—Anita M. King
*Assistant Examiner*—A. Joseph Wujciak

(57) ABSTRACT

A golf bag with integrally formed, automatically retractable golf bag stand is provided including a golf bag having a rigid open top and a rigid closed bottom with a tubular intermediate portion therebetween. The top is open for the positioning of golf clubs therethrough for support on the bottom and within an interior space of the intermediate. The bag further includes a pivotal foot pivotally coupled to the bottom of the bag. A pair of legs are pivotally coupled with respect to the bag. The legs have lower ends adapted to support the bag in a tripod orientation in association with the bottom of the bag. A pair of actuation rods have upper ends pivotally coupled to the legs and lower ends coupled to the pivotal foot at the bottom of the bag. As such, resting the bag on a recipient surface and pivoting it forwardly pushes the actuation rod upwardly to extend the legs outwardly in a tripod orientation and the lifting of the bag will allow the foot to move downwardly in co-planar relationship with the planar extent of the bottom to retract the legs for carrying the bag.

20 Claims, 3 Drawing Sheets

FIG 5
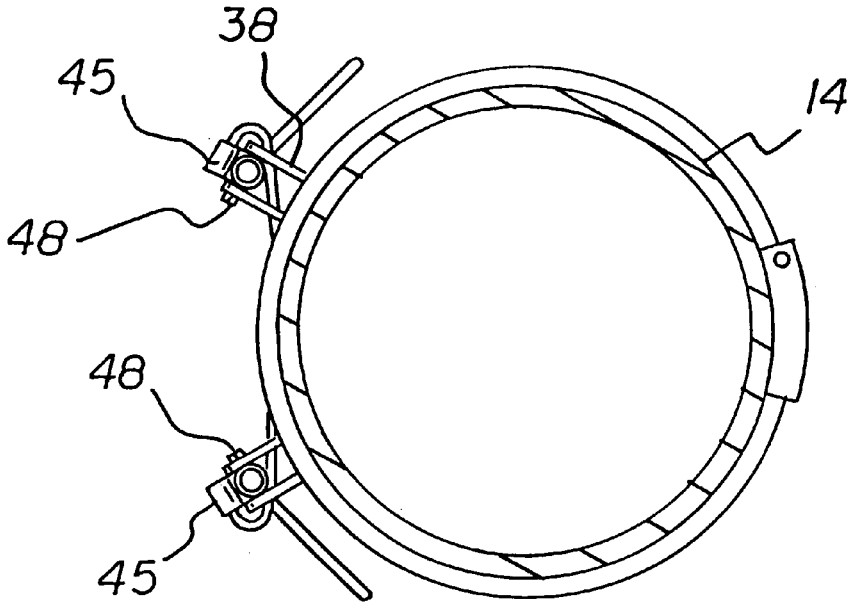
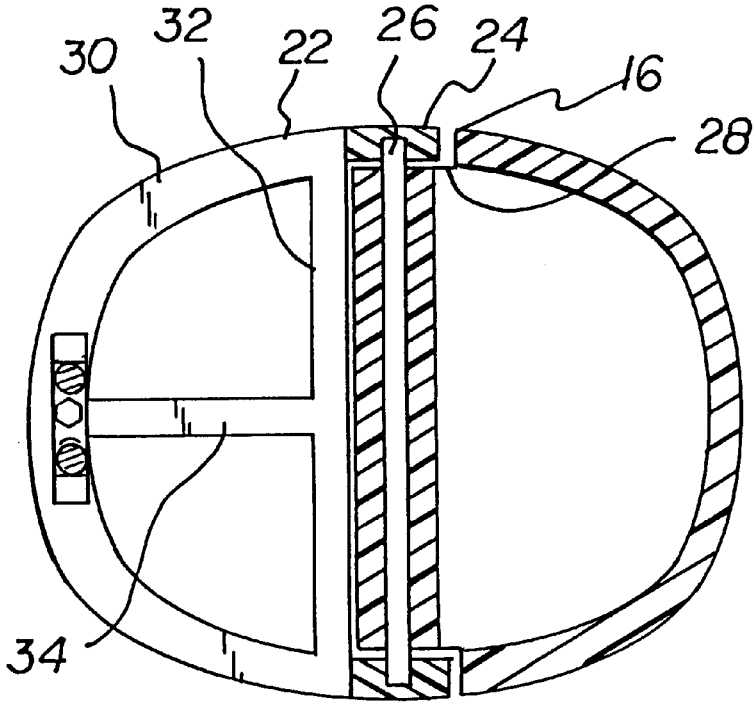
FIG 6

AUTOMATIC GOLF BAG SUPPORT STAND

CROSS-REFERENCE TO RELATED APPLICATION

This is a continuation of U.S. patent application Ser. No. 08/982,558 filed Dec. 2, 1997.

BACKGROUND OF THE INVENTION

1. Field of the Invention

The present invention relates to a new and improved automatic golf bag support stand and, more particularly, pertains to automatically supporting a golf bag with an integrally formed stand.

2. Description of the Prior Art

The use of golf bag stands is known in the prior art. More specifically, golf bag stands heretofore devised and utilized for the purpose of supporting a golf bag when not in use are known to consist basically of familiar, expected, and obvious structural configurations, notwithstanding the myriad of designs encompassed by the crowded prior art which has been developed for the fulfillment of countless objectives and requirements.

The prior art discloses a large number of golf bag support stands. By way of example, U.S. Pat. No. 4,834,235 to Solheim discloses golf bag with extensible support stand. U.S. Pat. No. Re. 33,203 to Reimers discloses a golf bag device. U.S. Pat. No. 4,921,192 to Jones discloses a golf bag having integrally support stand. U.S. Pat. No. 5,152,483 to Maeng discloses a golf bag with support stand. U.S. Pat. No. 5,356,003 to Gretz et al. discloses a golf bag with stand. U.S. Pat. No. 5,415,285 to Reimers discloses a soft sided golf bag with quick action integral stand. U.S. Pat. Des. 377,748 to Keller et al. discloses the ornamental design for a golf bag leg hinge bracket. Lastly, U.S. Pat. No. 846,552 to Collins discloses an automatic folding stand.

In this respect, the automatic golf bag support stand according to the present invention substantially departs from the conventional concepts and designs of the prior art, and in doing so provides an apparatus primarily developed for the purpose of automatically supporting a golf bag with an integrally formed stand.

Therefore, it can be appreciated that there exists a continuing need for a new and improved automatic golf bag support stand which can be used for automatically supporting a golf bag with an integrally formed stand. In this regard, the present invention substantially fulfills this need.

SUMMARY OF THE INVENTION

In view of the foregoing disadvantages inherent in the known types of golf bag stands now present in the prior art, the present invention provides a new and improved automatic golf bag support stand. As such, the general purpose of the present invention, which will be described subsequently in greater detail, is to provide a new and improved automatic golf bag support stand and methods which have all the advantages of the prior art and none of the disadvantages.

To attain this, the present invention essentially comprises a golf bag having a rigid open top and a rigid closed bottom with a tubular intermediate portion therebetween. The top is open for the positioning of golf clubs for support on the bottom and within an interior space of the intermediate portion. As shown in FIG. 2, the bottom has a planar extent for about half of its extent and an angled extent for the remainder of its extent to define a triangular shaped recess. A pivotal foot is pivotally coupled to the bottom of the bag and resides below the angled extent thereof. The intermediate portion has an interior surface and an exterior surface with a slot therethrough in proximity to the bottom. Also included is a handle formed on a front of the intermediate portion adjacent to the top. A pair of projections extend radially outward from the intermediate portion adjacent to the top. The projections have aligned circular apertures extended which opens through the interior surface and exterior surface. A pair of short rods have interior ends with apertures. Pins extend through the apertures of the projections and short rods for the pivotal coupling of the short rods with respect to the bag. The short rods have exterior ends with axial apertures and a circular bearing hole extending therethrough radially outwardly of the axis of the short rods. Next provided is a pair of cylindrical legs having upper ends extending into the axial apertures of the short rods. As such, the legs are adapted for pivoting therewithin with respect to the apertures of the projections. The legs have an inward bend between their midpoints and their upper ends. The long legs have lower ends adapted to support the bag in a tripod orientation in association with the bottom of the bag. Lastly, a pair of actuation rods have upper ends bent through the bearing holes of the short rods. The rods further has a U-shaped lower end with an aperture. Such aperture is coupled to the pivotal foot at the bottom of the bag via a bolt. As shown in FIG. 4, an intermediate extent of the actuator rods extends through the slot in the bag. By this structure, the bag may be rested on a recipient surface and pivoted forwardly to push the actuation rod upwardly to extend the legs outwardly in a tripod orientation. Further, by lifting of the bag, the foot is move downwardly in co-planar relationship with the planar extent of the bottom and the legs are retracted for carrying the bag.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automatic golf bag support stand which has all the advantages of the prior art golf bag stands and none of the disadvantages.

It is another object of the present invention to provide a new and improved automatic golf bag support stand which may be easily and efficiently manufactured and marketed.

It is a further object of the present invention to provide a new and improved automatic golf bag support stand which is of a durable and reliable construction.

An even further object of the present invention is to provide a new and improved automatic golf bag support stand which is susceptible of a low cost of manufacture with regard to both materials and labor, and which accordingly is then susceptible of low prices of sale to the consuming public, thereby making such a automatic golf bag support stand economically available to the buying public.

Even still another object of the present invention is to automatically support a golf bag with an integrally formed stand.

Lastly, it is an object of the present invention to provide golf bag with integrally formed, automatically retractable golf bag stand including a golf bag having a rigid open top and a rigid closed bottom with a tubular intermediate portion therebetween. The top is open for the positioning of golf clubs for support on the bottom and within an interior space of the intermediate. The bag further includes a pivotal foot pivotally coupled to the bottom of the bag. A pair of legs are pivotally coupled with respect to the bag. The legs have lower ends adapted to support the bag in a tripod orientation in association with the bottom of the bag. A pair of actuation rods have upper ends pivotally coupled to the legs and lower ends coupled to the pivotal foot at the bottom of the bag. As such, resting the bag on a recipient surface and pivoting it forwardly pushes the actuation rod upwardly to extend the legs outwardly in a tripod orientation and the lifting of the bag will allow the foot to move downwardly in co-planar relationship with the planar extent of the bottom to retract the legs for carrying the bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a top view of the present invention.

FIG. 6 is a bottom cross-sectional view of the present invention.

The same reference numerals refer to the same parts throughout the various Figures.

DESCRIPTION OF THE PREFERRED EMBODIMENT

Figure 1:
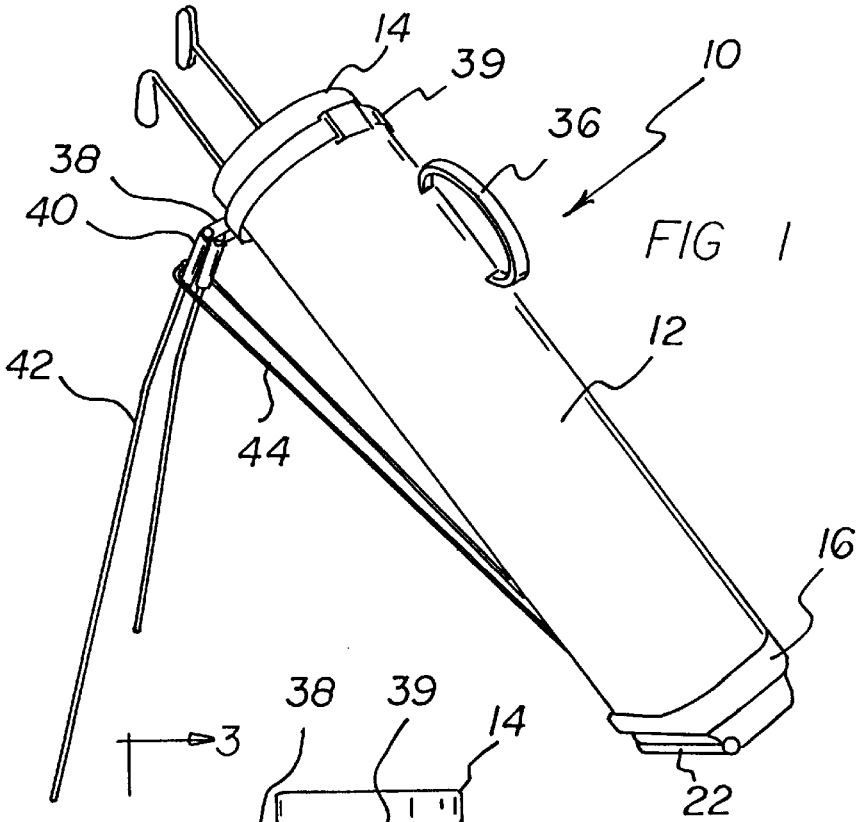
FIG. 1 is a perspective illustration of the preferred embodiment of the automatic golf bag support stand constructed in accordance with the principles of the present invention.

With reference now to the drawings, and in particular to FIGS. 1 through 6 thereof, the preferred embodiment of the new and improved automatic golf bag support stand embodying the principles and concepts of the present invention and generally designated by the reference numeral 10 will be described.

The present invention, the new and improved automatic golf bag support stand is a system 10 comprised of a plurality of components. Such components, in their broadest context, include a bag, legs, pivotal foot, and actuator rods. Each of the individual components is specifically configured and correlated one with respect to the other so as to attain the desired objectives.

Figure 2:
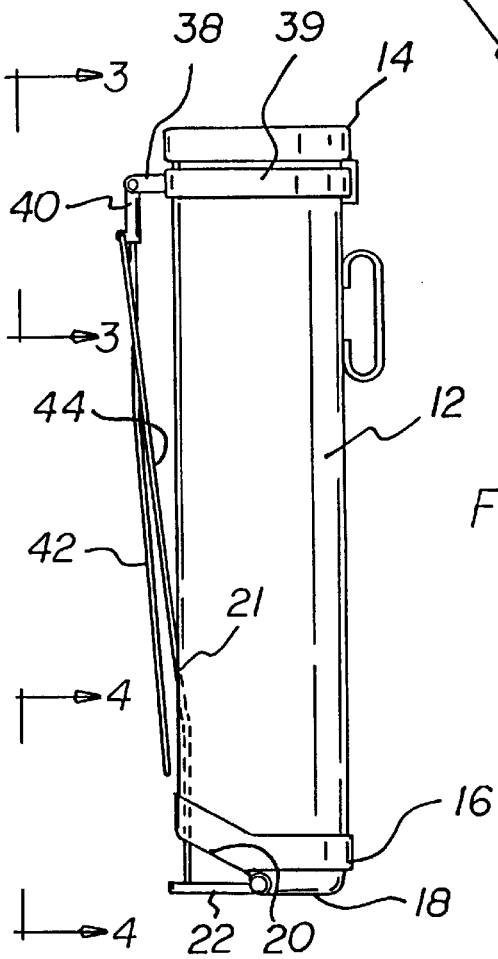
FIG. 2 is a side view of the present invention.
Figure 3:
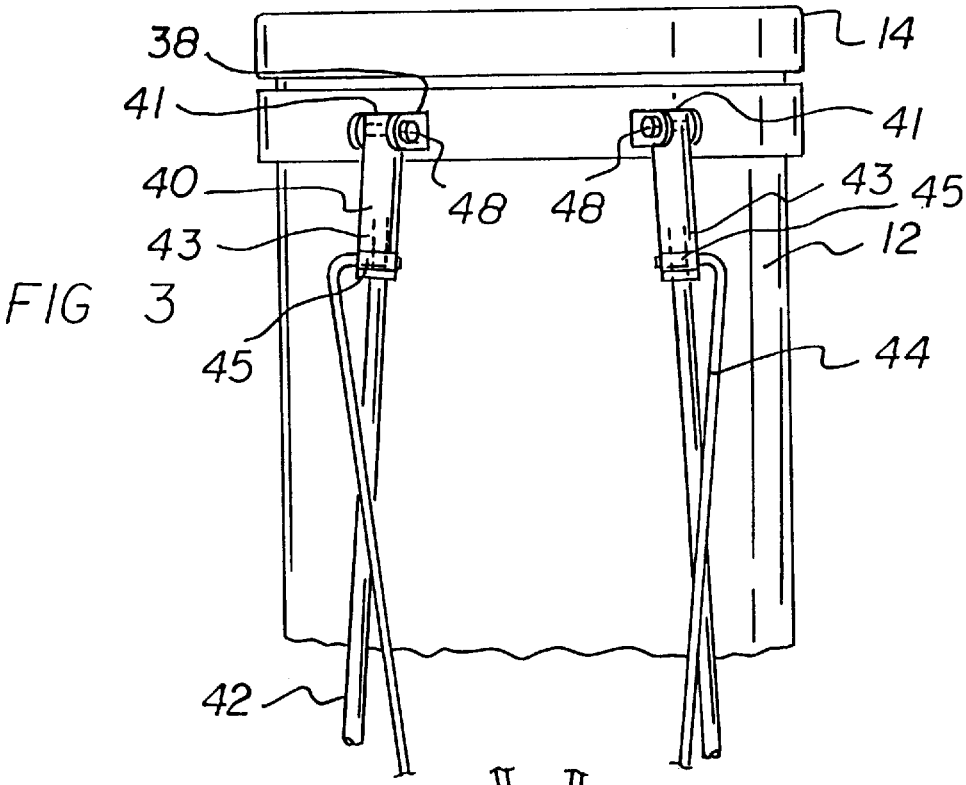
FIG. 3 is an upper rear view of the legs, rods projections and legs of the present invention.

The present invention, designated as numeral 10, includes a golf bag 12 having a rigid open top 14 and a rigid closed bottom 16 with a tubular intermediate portion therebetween for fixing the open top and closed bottom with respect to each other. The top is open for the positioning of golf clubs therethrough for support on the bottom and within an interior space of the intermediate portion. As shown in FIG. 2, the bottom has a planar extent 18 for about half of its extent and an angled extent 20 for the remainder of its extent to define a triangular shaped recess. The intermediate portion has an interior surface and an exterior surface with a slot which extends through the surfaces in proximity to the bottom. As shown in FIG. 2, the slot has a length that is less than ½ the length of the bag.

A pivotal foot 22 is pivotally coupled to the bottom of the bag along an intersection of the planar and angled extent. Such intersection is preferably formed along a diameter of the bottom of the bag. Further, the pivotal foot resides below the angled extent of the bottom of the bag during use. As shown in FIG. 6, the bottom includes a pair of arms 24 extending rearwardly therefrom for pivotally coupling about a post 26 mounted to the bottom of the bag. Ends of the post and the arms both reside in recesses 28 of the bottom of the bag during use. It should be further noted that the pivotal bottom includes, a U-shaped member 30 with a rear member 32 connected between ends thereof. Finally, a central member 34 is integrally formed between a central extent of the U-shaped member and rear member such that all of the members remain in co-planar relationship.

Also included is a handle 36 formed on a front of the intermediate portion adjacent to the top. As shown in FIG. 1, the handle comprises a flexible rectangular strip having ends connected to the bag along a line which remains in parallel with an axis of the bag.

A pair of projections 38 extend radially outward from the intermediate portion of the bag adjacent to the top thereof. The projections have aligned circular apertures. As shown in FIG. 5, the projections are angularly spaced by about 60 degrees and extend radially less than ¼ the radius of the open top of the bag. In the preferred embodiment, the projections are mounted to the bag via an annular rigid cuff 39 secured adjacent to the top of the bag.

A pair of short rods 40 have interior ends with apertures 41. Pins 48 extend through the apertures of the projections and short rods for the pivotal coupling of the short rods with respect to the projections and bag. The short rods have exterior ends with axial apertures and a circular bearing hole extending therethrough radially outwardly of the axis of the short rods. Such bearing hole of each short rod ideally resides adjacent to and above the exterior end thereof.

Next provided is a pair of cylindrical legs 42 having an inward bend between their midpoints. As such, each leg is defined by an elongated linear portion which forms an obtuse angle of greater than 120 degrees with a short linear portion. The upper ends of the leg extend of the short rods.

During use, the legs are adapted for pivoting with respect to the apertures 43 of the projections. The long legs have lower ends adapted to support the bag in a tripod orientation in association with the bottom of the bag.

Figure 4:
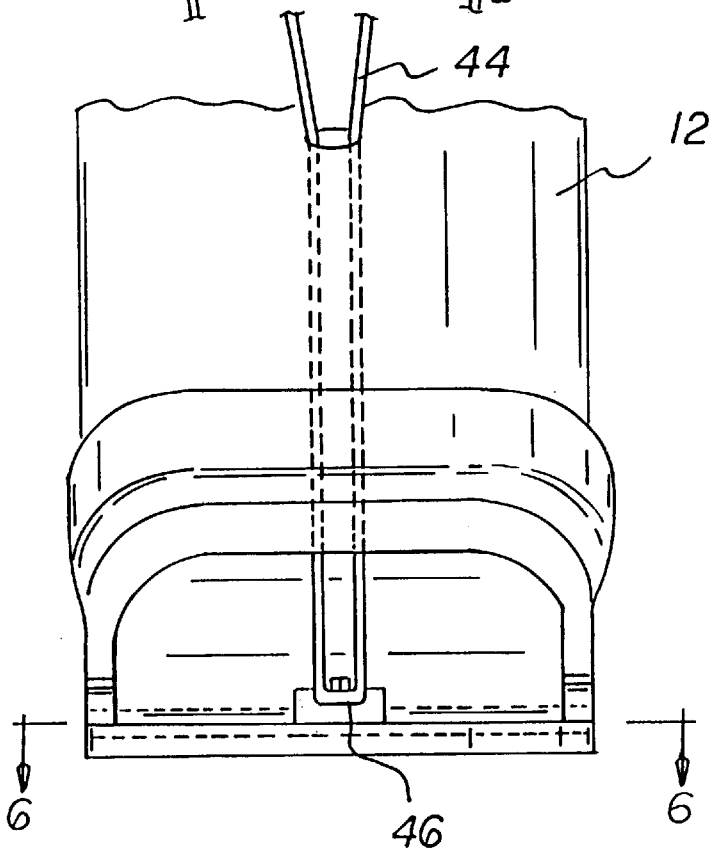
FIG. 4 is a lower rear view of the rods and pivotal foot of the present invention.

Lastly, a pair of actuation rods 44 have upper ends bent through the bearing holes 45 of the short rods. The rods further has a U-shaped lower end 46 with an aperture 47. Such aperture is coupled to the pivotal foot at the bottom of the bag via at least one bolt. As shown in FIG. 6, such coupling is effected at an intersection of the central member and U-shaped member of the pivotal foot. As shown in FIG. 4, an intermediate extent of each of the actuator rods extends through the slot in the bag.

With reference still to FIG. 4, it is shown that the portions of the actuator rods within the slot are maintained in parallel while portions above the former portions extend away from each other to couple with the respective short rod. For reasons that will become apparent later, the actuator rods are resilient in nature.

By this structure, the bag may be rested on a recipient surface and pivoted forwardly to push the actuation rod upwardly to extend the legs outwardly in a tripod orientation. Further, by lifting of the bag, the foot is move downwardly in co-planar relationship with the planar extent of the bottom and the legs are retracted for carrying the bag. Such retraction is further urged by the tendency of the actuator rods to remain linear and in parallel with respect to each other.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf bag with an automatically retractable golf bag stand comprising:

a rigid open top and a rigid closed bottom with a tubular intermediate portion therebetween and a handle, the top being open for the positioning of golf clubs within an interior space of the intermediate portion, the intermediate portion having an interior surface at least partially defining said interior space and an exterior surface and being formed with a slot extending between said interior surface and exterior surface, the bottom having a first planar extent for about half of an extent of the bottom, a recessed extent for the remainder of the extent of the bottom to define a lower recess and a pivotal foot pivotally coupled to the bottom of the bag and disposed below the recessed extent thereof;

a pair of projections extending outwardly from the intermediate portion adjacent to the top of the intermediate portion;

a pair of connector members each pivotally coupled to a projection;

a pair of legs having upper ends connecting with the connector member, the legs having lower ends adapted to support the bag in a tripod orientation in association with the bottom of the bag;

an actuator comprising a pair of actuation rods, each rod of said pair of actuation rods having an upper end and a lower end, the upper ends of each of the actuation rods being pivotally mounted to the connector members and the lower ends of each of the actuation rods being connected by a lower actuator portion pivotally coupled to the pivotal foot at the bottom of the bag and a portion of the actuator extending through the slot in the bag and through the recessed extent whereby resting the bag on a recipient surface and pivoting it forward pushes the actuation rods upwardly to extend the legs outwardly in a tripod orientation through the application of an essentially perpendicular force between the foot and the lower actuator portion and the lifting of the bag will allow the foot to move downwardly in co-planer relationship with the first planer extent of the bottom to retract the legs for carrying the bag.

2. The golf bag of claim 1 wherein said projections each define aligned apertures.

3. The golf bag of claim 2 wherein said connector members each have proximal ends with apertures and pins extending through the apertures of the projections and connector members to pivotally couple the connector members with respect to the bag.

4. The golf bag of claim 1 wherein the slot is located adjacent to the bottom of the bag.

5. The golf bag as set forth in claim 1 wherein the slot has a length of less than one half that of the bag.

6. The golf bag of claim 1 wherein the bottom has a planar extent for about one half of its extent and an angled extent for the remainder of its extent to define a substantially triangular shaped recess.

7. The golf bag of claim 1 wherein the actuation rods curve continuously away from each other as said rods extend from the lower ends to the upper portions thereof.

8. A golf bag and an integrally formed, automatically retractable golf bag stand comprising, in combination:

a golf bag comprising an open top and a rigid closed bottom with a tubular intermediate portion therebetween, the top being open for the positioning of golf clubs therethrough within an interior space of the intermediate portion, the intermediate portion having an interior surface at least partially defining said interior space and an exterior surface and being formed with a slot extending exteriorly from said interior space, the bottom having a first planar extent for about half of an extent of the bottom, a recessed extent for the remainder of the extent of the bottom to define a lower recess and a pivotal foot pivotally coupled to the bottom of the bag below the recessed extent thereof, said recessed extent defining an opening;

a mounting bracket extending from the golf bag;

a pair of connector members each pivotally coupled to the bracket;

a pair of legs each having an upper end connecting a connector member, the legs having lower ends adapted to support the bag in a tripod orientation in association with the bottom of the bag;

an actuator comprising a pair of actuation rods, each of said actuation rods having an upper end and a lower end, the upper ends of each of the actuation rods being bent and pivotally connecting a connector member and the lower ends of each of the actuation rods connected by a lower actuator portion coupled to the pivotal foot at the bottom of the bag and a portion of the actuator extending through the slot in the bag and through the recessed extent opening whereby resting the bag on a recipient surface and pivoting it forwardly pushes the actuation rods upwardly to extend the legs outwardly in a tripod orientation through the application of a force to the foot and the lower actuator portion and the lifting of the bag will allow the foot to move downwardly in co-planer relationship with the first planer extent of the bottom to react the legs for carrying the bag.

9. The golf bag and stand of claim 8 wherein said bracket comprises a pair of projections which each define aligned apertures.

10. The golf bag and stand of claim 9 wherein said connector members each have proximal ends with apertures and pins extending through the apertures of the projections and connector members to pivotally couple the connector members with respect to the bag.

11. The golf bag and stand of claim 8 wherein the slot is located adjacent to the bottom of the bag.

12. The golf bag and stand as set forth in claim 8 wherein the slot has a length of less than one half that of the bag.

13. The golf bag and stand of claim 8 wherein the actuation rods curve continuously away from each other as said rods extend from the lower ends to the upper portions thereof.

14. A golf bag with an integrally formed, automatically retractable golf bag stand comprising, in combination:

a rigid open top and a rigid closed bottom with a tubular intermediate portion therebetween, the top being open for the positioning of golf clubs within an interior space of the intermediate portion, the intermediate portion being formed with a slot defining a bag opening which communicates with said interior space, the bottom having a first planer extent and a recessed extent for the remainder of the extent of the bottom to define a lower recess and a pivotal foot below the angled extent thereof and pivotally coupled to the bottom of the bag, said recessed extent defining a recessed extent opening;

a pair of mounts mounted to the intermediate portion;

a pair of leg units each having an upper portion pivotally mounted to one of the mounts;

the leg units having lower ends adapted to support the bag in a tripod orientation in association with the bottom of the bag;

an actuator comprising a pair of actuation rods, each said actuation rod having an upper end and a lower end, the upper ends of each of the actuation rods pivotally mounted to said leg units and lower ends of each of the actuation rods being connected by a lower actuator portion to the pivotal foot at the bottom of the bag for pivoting therewith and the lower actuator portion extending through the slot in the bag and through the recessed extent opening whereby resting the bag on a recipient surface and pivoting it forwardly pushes the actuation rods upwardly to extend the legs outwardly in a tripod orientation through the application of force urging the recessed extent toward the foot and the lifting of the bag will allow the foot to move downwardly to retract the legs for carrying the bag.

15. The golf bag of claim 14 wherein said mounts each define aligned apertures.

16. The golf bag of claim 15 wherein said connector members each have proximal ends with apertures and pins extending through the apertures of the projections and connector members to pivotally couple the connector members with respect to the bag.

17. The golf bag of claim 14 wherein the slot is located adjacent to the bottom of the bag.

18. The golf bag of claim 14 wherein the bottom has a planar extent for about one half of its extent and an angled extent for the remainder of its extent to define a substantially triangular shaped recess.

19. The golf bag of claim 14 wherein the actuation rods curve continuously away from each other as said rods extend from the lower ends to the upper portions thereof.

20. The golf bag of claim 14 wherein the connector members define openings and the actuation rods are received in the openings.

* * * * *